US008291809B2

(12) United States Patent
Eaglestone

(10) Patent No.: US 8,291,809 B2
(45) Date of Patent: Oct. 23, 2012

(54) FIELD GUN

(75) Inventor: David Andrew Eaglestone, Cumbria (GB)

(73) Assignee: BAE Systems plc, London (GB)

( * ) Notice: Subject to any disclaimer, the term of this patent is extended or adjusted under 35 U.S.C. 154(b) by 715 days.

(21) Appl. No.: 12/291,059

(22) Filed: Apr. 1, 2009

(65) Prior Publication Data

US 2012/0097016 A1 Apr. 26, 2012

(30) Foreign Application Priority Data

Apr. 14, 2008 (GB) ..... 0806789.4

(51) Int. Cl.
*F41G 3/00* (2006.01)

(52) U.S. Cl. ..... 89/41.01; 89/37.01; 89/40.01

(58) Field of Classification Search ..... 89/41.01, 89/37.01, 40.01

See application file for complete search history.

(56) References Cited

U.S. PATENT DOCUMENTS

| | | | |
|---|---|---|---|
| 4,440,061 | A | 4/1984 | Magnuson |
| 5,922,987 | A | 7/1999 | Hoffman et al. |
| 2002/0007726 | A1 | 1/2002 | Boissiere et al. |
| 2007/0051235 | A1 | 3/2007 | Hawkes et al. |

FOREIGN PATENT DOCUMENTS

| | | | |
|---|---|---|---|
| DE | 2349720 | A1 | 5/1975 |
| DE | 3623652 | A1 | 1/1988 |
| EP | 0013422 | A1 | 7/1980 |
| EP | 0013422 | B1 | 5/1982 |
| EP | 0127601 | A2 | 12/1984 |
| EP | 0140053 | A2 | 5/1985 |
| EP | 1113239 | A2 | 7/2001 |
| FR | 717936 | | 1/1932 |

OTHER PUBLICATIONS

PCT International Search Report mailed Sep. 23, 2009.
PCT International Preliminary Report on Patentability.
PCT Written Opinion of the International Searching Authority issued Oct. 19, 2010.
British Search Report, dated Oct. 28, 2008.
British search report dated Jun. 1, 2009.
European search report dated Jul. 21, 2009.

*Primary Examiner* — Michelle Clement
(74) *Attorney, Agent, or Firm* — Crowell & Moring LLP

(57) ABSTRACT

A field gun comprising: a chassis, a barrel defining a barrel axis and having a traverse range and an elevation range, a cradle supporting the barrel, a joint for enabling pivoting in at least two axes, the joint connecting the cradle to the chassis, a first linear actuator, extensible along a first linear actuator axis, pivotally attached to a first point on the chassis and pivotally attached to a first point on the cradle, a second linear actuator, extensible along a first linear actuator axis, pivotally attached to a second point on the chassis and pivotally attached to a second point on the cradle, such that a first combination of first linear actuator and second linear actuator actuation varies the traverse a second combination of first linear actuator and second linear actuator actuation varies the elevation.

14 Claims, 4 Drawing Sheets

FIELD GUN

The invention relates to a field gun.

A known field gun 50 is shown in prior art FIGS. 5*a* and 5*b* and comprises a soleplate 52 and a saddle 54. The soleplate 52 rests on the ground and supports the weight of the gun 50. Extending from the general centre of the soleplate 52 is a swivel mount 53. The saddle 54 has a base 55 connected to the swivel mount 53 so that the saddle is able to rotate relative to the soleplate 52 in an azimuth plane generally parallel to a surface of the ground 51. A geared drive 59 is provided for controlling rotation of the saddle with respect to the soleplate.

A cradle supports a gun barrel and comprises trunnions 58 which form a pivot joint 57 with saddle 54. The cradle can pivot about pivot joint 57 and a pair of linear actuators are provided for controlling rotation of the gun barrel in a vertical plane with respect to the soleplate. A nearside actuator 56 is shown in FIG. 5*a* and extends between the cradle and the saddle.

Accordingly, the gun barrel can be aimed by controlling rotation in the azimuth plane about swivel mount 53 and in a vertical plane about pivot joint 57. Rotation of a gun barrel in the azimuth plane is typically referred to as traversing.

Such an aiming mechanism provides a range of potential trajectories from a single grounding when the field gun is in a fixed or temporary position. However, in the prior art, the saddle is the only means by which the soleplate is connected to the cradle and therefore the saddle must absorb the substantial recoil forces generated when the gun is fired. In order to withstand these forces, the saddle therefore tends to be of an appropriately substantial form, for example the saddle tends to have a wide base. This in turn adds weight to the gun.

It is therefore an aim of the present invention to provide an improved field gun. The embodiments of the invention, described in more detail with reference to the drawings, do not rely upon the provision of a saddle and soleplate arrangement to effect aim. This can lead to a simplified aiming mechanism, thus potentially enabling lighter aiming mechanism designs.

According to an aspect of the invention there is provided a field gun comprising: a chassis, a barrel defining a barrel axis and having a traverse range and an elevation range, a cradle supporting the barrel, a trunnion joint for enabling pivoting in at least two axes, the trunnion joint connecting the cradle to the chassis, a first linear actuator, extensible along a first linear actuator axis, pivotally attached to the chassis by a first chassis joint, and pivotally attached to the cradle by a first cradle joint, a second linear actuator, extensible along a second linear actuator axis, pivotally attached to the chassis by a second chassis joint and pivotally attached to the cradle by a second cradle joint, such that a first combination of first linear actuator and second linear actuator actuation varies the traverse a second combination of first linear actuator and second linear actuator actuation varies the elevation.

Advantageously this reduces the overall mass of a field gun because there need be only two linear actuators for varying both the azimuth and the elevation. Comparing this with the M777, this does away with the need for a saddle rotating gear. Such a reduction in mass makes the gun easier to transport e.g. by a transport aircraft and also makes the gun easier to reposition to other firing sites.

Additionally, this provides more than one interface between the chassis (which can be static as the barrel is aimed) and the cradle. In particular these interfaces are provided by the trunnion joint between the cradle and the chassis, the first linear actuator between the cradle and the chassis, and the second linear actuator between the cradle and the chassis.

Thus the firing forces are transmitted to the chassis not only via the trunnion joint but also via the linear actuators. This reduces the maximum load on the trunnion joint and hence allows the use of a less substantial aiming means than the saddle of the M777.

Preferably when the barrel is in the midpoint of the barrel traverse range the first linear actuator axis is substantially inclined to the barrel axis, in particular this inclination may be 20-60°.

Advantageously this enables the linear actuators to move the barrel effectively, whilst still providing structural support along the barrel axis. Shallower angles than this would require longer linear actuators due to the smaller component of the force contributing to barrel displacement. Deeper angles would not provide enough axial support to the barrel over the course of firing.

Preferably when the barrel is in the midpoint of the barrel traverse range, the second linear actuator axis is substantially inclined to a plane defined by the barrel axis and the first linear actuator axis, in particular this inclination may be 20-60°.

Advantageously, this effectively forms a tripod which is a robust shape that is simple and light.

Preferably the first chassis joint, relative to a polar axis extending forwards from the trunnion joint along an elevation datum line generally parallel to the ground plane, is at a position displaced from the trunnion joint by radius $r_1$ and angle $\theta_1$, wherein the magnitude of $\theta_1$ is greater than 90° but less than 180°.

Preferably, when the barrel is at zero elevation, the first cradle joint is displaced from the trunnion joint by radius $r_2$ and angle $\theta_2$ wherein $r_1$ is less than $r_2$ and $\theta_2$ is less than 90° but greater than 0°.

Each of these preferential embodiments advantageously act to maximise the elevation range.

Preferably the first and second linear actuators are arranged generally symmetrically about the barrel axis when the barrel is at the traverse range midpoint.

Advantageously this tends to distribute forces and stresses evenly over the gun when firing the barrel from the midpoint and tends to reduce the maximum moment arms when the barrel is fired from the extremities of its axis range. Hence the gun is more robust.

Preferably, the first and second linear actuators are connected to each respective site on the cradle and chassis by a global pivot joint or alternatively by a universal joint.

Advantageously this provides an infinite-axis pivot and so does not constrain the field gun so as to substantially prevent the extension of the linear actuator from moving the barrel; as the barrel varies its traverse, the pivot joint should enable pivoting in a first direction and as the barrel varies its elevation, the pivot joint should enable pivoting in a second direction perpendicular to the first. The pivot joint should also enable the simultaneous varying of traverse and elevation.

Preferably the chassis is for contacting a ground plane and comprises: at least one back stabilising leg for contacting the ground plane at a backmost point, at least one front stabilising leg for contacting the ground plane at a foremost point.

Advantageously this tends to provide a stable platform for firing and so improves the accuracy of the weapon.

Preferably the chassis comprises a self-propulsion means.

Advantageously this allows coarse alterations of the aim (i.e. those outside of the range of the barrel movements relative to a static chassis) to be effected swiftly by relocating the chassis under its own power. This can reduce the size of the operational crew and so make the weapon easier to deploy.

Preferably the chassis comprises an automated handling system for re-loading the gun between firing.

This can reduce the size of the operational crew and so make the weapon easier to deploy.

So that the invention may be fully understood, two possible embodiments of the invention shall be described with respect to the figures, of which:—

Figure 2:
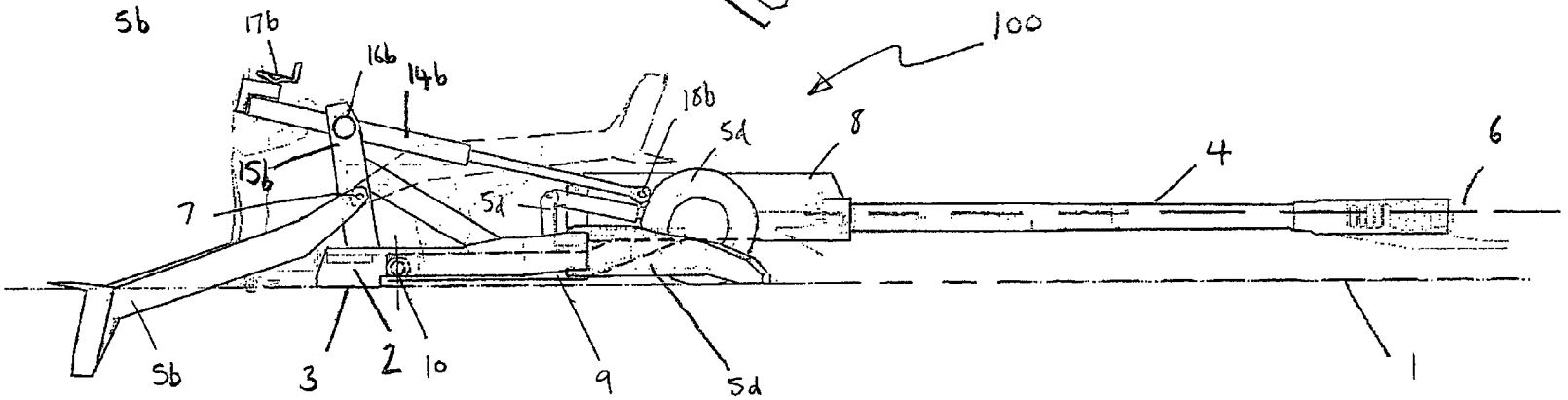
FIG. 2 shows a second view of the field gun of FIG. 1, where the gun barrel is shown positioned at zero elevation.
Figure 2A:
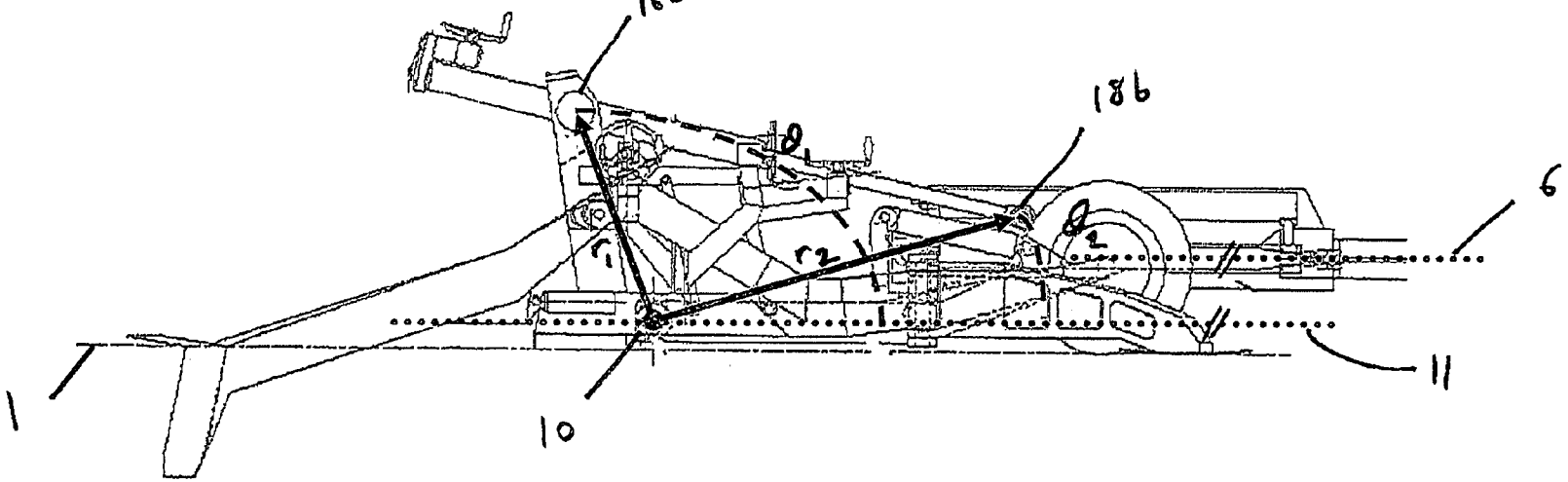
Figure 3:
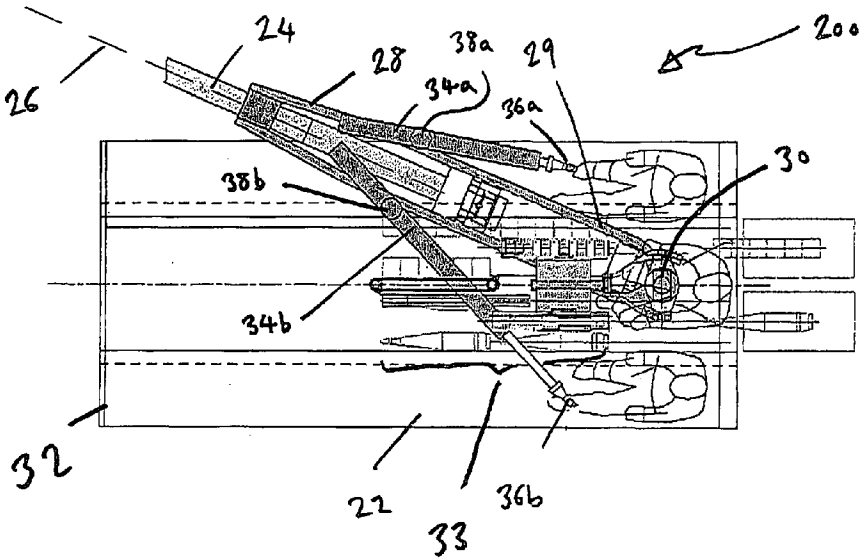
Figure 4:
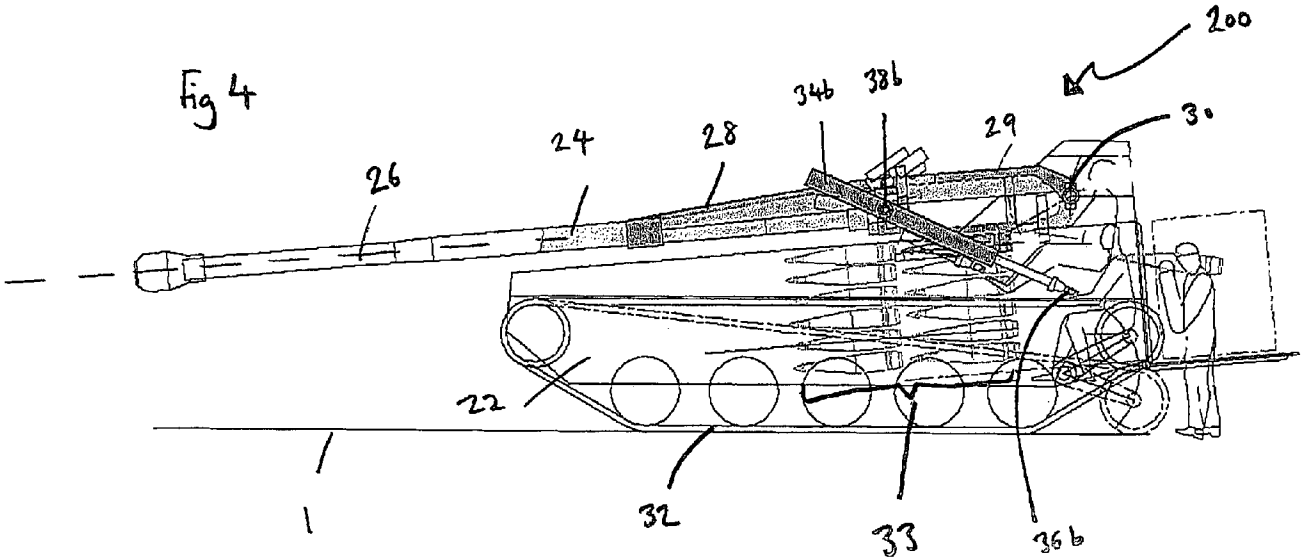

FIG. 2*a* shows an annotated close up view of FIG. 2 so as to illustrate the geometrical arrangement of the joints;

FIG. 3 shows a first view of a self-propelled field gun according to a second embodiment of the present invention, with the field gun being arranged such that the barrel is positioned towards an extremity of its traverse range;

FIG. 4 shows a second view of the field gun of FIG. 3; and

Figure 5A:
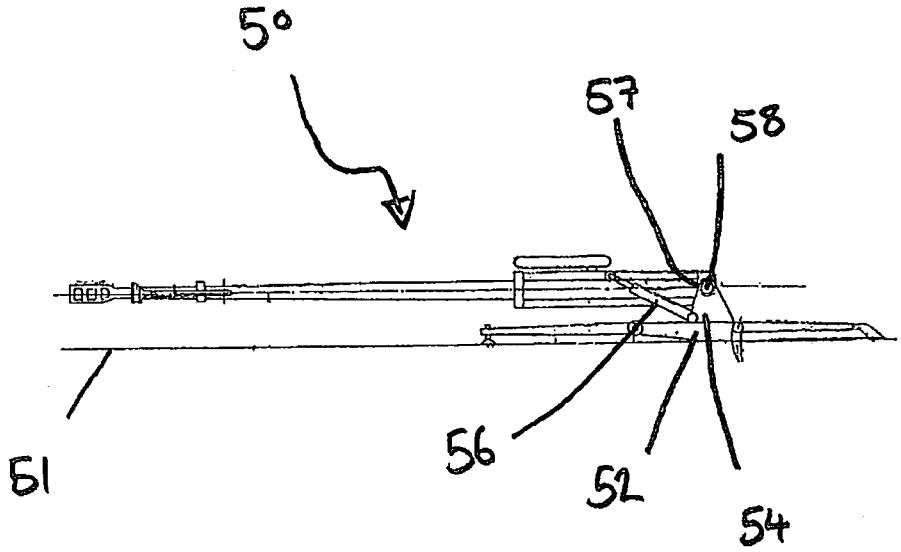
fig 5a PRIOR ART
Figure 5B:
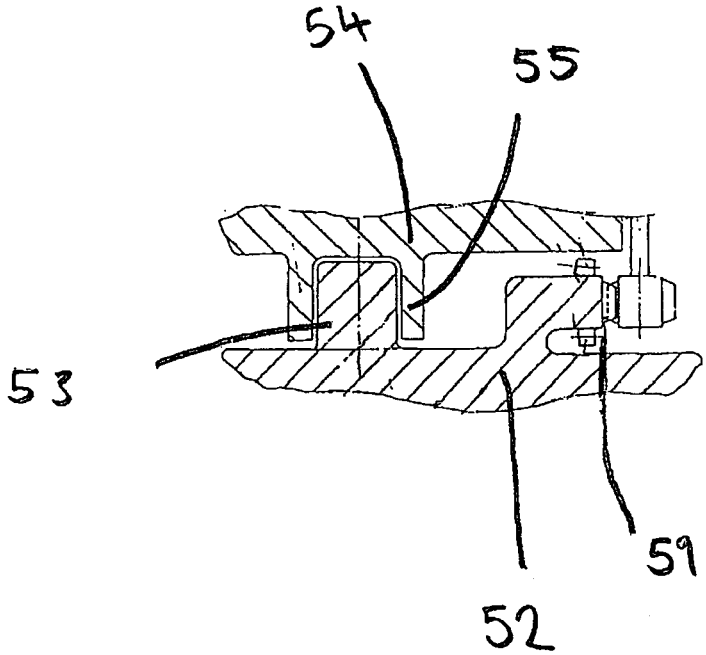
fig 5b PRIOR ART

FIGS. 5*a* and 5*b* show a prior art field gun, and more specifically FIG. 5*a* shows a side-on view of the prior art field gun, and FIG. 5*b* shows a side-on view of a section through a centreline of the field gun.

Figure 1:
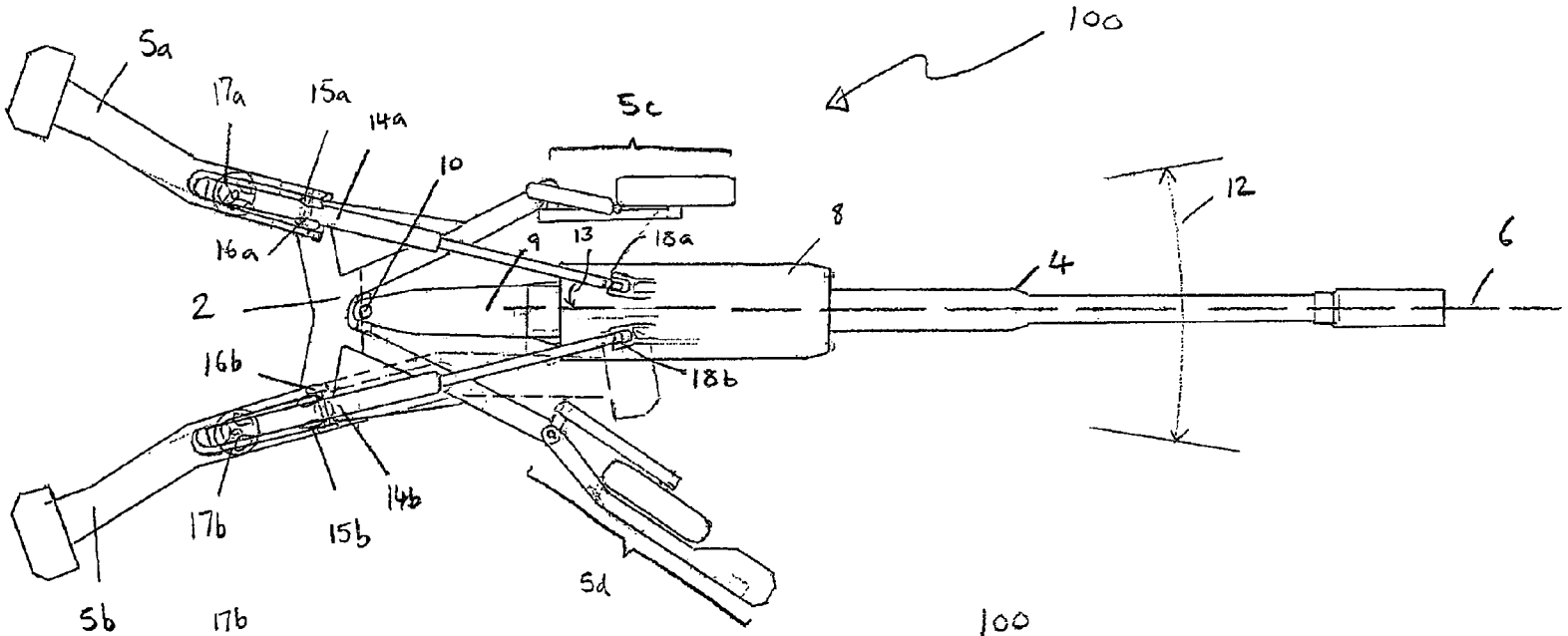
FIG. 1 shows a first view of a towable field gun according to a first embodiment of the invention, the field gun arranged so that the barrel is in the midpoint of its traverse range and aligned with the field gun centreline.

Referring to FIGS. 1 and 2, a field gun 100 is shown which comprises a chassis 2 deployed on a surface of the ground, which for simplicity is shown as ground plane 1. The chassis 2 comprises a base 3 and stabilising legs 5*a*, 5*b*, 5*c* and 5*d*. Trailing stabilising legs 5*a* and 5*b* (also known as trails) can be rotated about a hinge 7 so that legs 5*a* and 5*b* can be moved to a deployed condition (as shown in solid lines in FIGS. 1 and 2) for stabilising the field gun 100 in use and to a collapsed condition (as shown in broken lines) for transport.

As shown, base 3 and stabilising legs 5*c* and 5*d* contact the surface of the ground at respective positions and define a contact plane that is coplanar with the ground surface 1 when the field gun is in the deployed condition. the trailing legs 5*a* and 5*b* contact the ground plane 1 at respective positions. The trailing legs may comprise feet which can be driven into the ground to provide additional stability as shown.

The chassis 2 comprises a multi-axis trunnion joint 10 provided generally in the region of the base 3 so that trunnion joint 10 may be positioned close to the ground plane 1. The trunnion joint 10 connects the chassis 2 to an arm 9 of a cradle 8 thereby allowing the arm to be pivoted in multiple axes.

A barrel 4 is attached to the cradle 8 to allow for sliding relative movement so that the barrel 4 can recoil along a barrel axis 6 when a projectile is fired from the gun barrel. Relative sliding movement can be achieved by any suitable means, for instance by chase bearings (not shown).

The chassis 2 is provided with a first and second post 15*a*, 15*b* each of which extends from the base 3 and generally away from ground plane 1. The first and second posts 15*a* and 15*b* extend from the base 3 at a region that is backwards (to the left as shown in FIGS. 1 and 2) of the trunnion joint 10.

First and second linear actuators 14*a*, 14*b* extend between the cradle 8 and the first post 15*a* and the second post 15*b*, respectively. The linear actuators are lengthwise extendable. The linear actuators 14*a*, 14*b* are connected by first and second chassis joints 16*a*, 16*b* to respective upper portions of the first and second posts 15*a*, 15*b* and by first and second cradle joints 18*a*, 18*b* to the cradle 8. Chassis joints 16*a*, 16*b* are rearward of multi-axis joint 10 and Cradle joints 18*a*, 18*b* are forward of the trunnion joint 10.

Linear actuators 14*a*, 14*b* are pivotal about chassis joints 16*a*, 16*b* and cradle joints 18*a*, 18*b* in a vertical plane and a horizontal plane. Joints 16*a*, 16*b*, 18*a*, 18*b* may be global pivots, which may comprise a spherical interface between moving parts.

The extension or retraction of the linear actuators 14*a*, 14*b* can be manually actuated by rotating hand wheels 17*a* and 17*b*. Extension and retraction of linear actuators 14*a*, 14*b* control a distance between joints 16*a* and 18*a* and between joints 16*b* and 18*b*, respectively. Accordingly, the orientation of the cradle 8, and gun barrel 4, with respect to the chassis can be controlled by actuation of the linear actuators.

Hand wheels 17*a* and 17*b* each actuate a respective screw drive (not shown) that is internal to the linear actuator and which extends or retracts the linear actuator according to the direction of hand wheel 17*a* and 17*b* rotation. The dimensions of the field gun 100 and the arrangement of the hand wheels 17*a* and 17*b* are such that a single operator is able to rotate both drives at once.

As an alternative to screw drive actuation, the linear actuator 14*a*, 14*b* can be actuated by hydraulic means. Hydraulic means allow hand drives to be remote from the actuator and thus can be located in an optimal ergonomic arrangement.

Referring to FIG. 2*a*, trunnion joint 10 is coincident with an elevation datum line 11. Elevation datum line 11 is generally parallel with the ground plane 1 and hence generally parallel to the barrel axis 6 when elevation is zero.

The positions of joints 16*a* and 18*a* will now be described in more detail using polar coordinates. Chassis joint 16*b* is a distance $r_1$ from trunnion joint 10 and at an angle of $\theta_1$ with datum line 11. Cradle joint 18*b* is distance $r_2$ from trunnion joint 10 and at an angle $\theta_2$ with datum line 11. As shown in this embodiment $r_1$ is less than $r_2$, $\theta_1$ is greater than 90° but less than 180°, and $\theta_2$ is less than 90° but greater than 0°.

Although not specifically shown in FIG. 2*a*, joints 16*a* and 18*a* are arranged with respect to multi-joint 10 and datum line 11 in a manner equivalent to joints 16*a* and 18*a*.

In order to control an initial path of a projectile fired from the barrel 4 of the field gun, it is necessary to control an orientation of the gun barrel with respect to the chassis. Orientation can be controlled in a vertical plane which is generally referred to as elevation and in a horizontal, or azimuth, plane which is generally referred to as traverse.

As shown in FIGS. 1 and 2, arm 9 and linear actuators 14*a* and 14*b* form a tripod arrangement. The linear actuators form lengthwise extensible legs of the tripod while the arm 9 forms a leg of fixed length. For any given length of the first linear actuator, extension and retraction of the second linear actuator causes pivotal movement of the barrel axis 6 in a plane which intersects an angle between the first linear actuator and the arm. Likewise, for any given length of the second linear actuator, extension and retraction of the first linear actuator causes pivotal movement of the barrel axis 6 in a plane which intersects an angle between the second linear actuator and the arm. Accordingly, appropriate selection of lengths of the first and second linear actuators causes the barrel axis to be orientated at any one of a plurality angles with respect to both the vertical and azimuth planes thereby controlling traverse and elevation of the gun barrel.

For example, the barrel 4 is orientated in the midpoint of a traverse range 12 (as shown in FIGS. 1 and 2 where the barrel is also aligned with a centreline of the gun), by arranging the linear actuators symmetrically relative to the barrel axis 6. As shown, the first linear actuator 14*a* is orientated at an angle 13 to the barrel axis 6 which is approximately +25° and second linear actuator 14*b* is orientated at an angle to the barrel axis 6 which is approximately −25°. Equal extension or retraction of the first and second linear actuators 14*a*, 14*b* causes the barrel axis 6 to be orientated at a selected elevation at a traverse which is aligned with a gun central axis.

Also, the distances from the ground plane of the first chassis joint 16*a* and the second chassis joint 16*b* are equal and therefore both joints are contained in a plane which is parallel to the ground plane 1. Within this plane both joints 16*a* and 16*b* are laterally offset, by a generally equal amount, from a gun centre line.

The trunnion joint 10, the first chassis joint 16*a* and the second chassis joint 16*b* define a triangle. The barrel axis 6 passes through the triangle over the entire range of traverse and elevation configurations.

In operation, the gun barrel 4 can be aimed whilst the chassis 2 remains stationary. In order to vary the traverse only, one linear actuator extends at a certain rate and the other linear actuator retracts at the same rate. In order to vary the elevation, both linear actuators must either retract at the same rate (to increase elevation) or extend at the same rate (to reduce elevation). Forces generated during recoil are transferred principally through from the cradle 8 through arm 9 to the chassis 2 and are therefore more easily absorbed and transmitted to the ground than is the case with the prior art gun shown in FIGS. 5*a* and 5*b*.

Referring to FIGS. 3 and 4, a field gun 200 is shown which comprises a barrel 24 slidably attached to a cradle 28 such that the barrel 24 can slide along a barrel axis 26. The barrel 24 can be orientated, so as to aim the barrel 24, by means of linear actuators 34*a* and 34*b*. The cradle 28 comprises an arm 29 that extends to a multi-axis trunnion joint 30 whereby the cradle 28 is connected to a self-propelled chassis 22. The self-propelled chassis 22 is provided with a motorised tracked wheel base 32 for effecting self-propulsion and a handling system 33 for automatically reloading the gun between firings.

The linear actuators 34*a*, 34*b* are connected between joints 38*a*, 38*b* at the cradle 28 and joints 36*a*, 36*b* at the chassis 22, respectively. Chassis joints 36*a*, 36*b* are closer to the ground plane 1 than the trunnion joint 30.

The barrel 24 is aimed by extension or retraction of the linear actuators 34*a*, 34*b*, in the same manner as the first embodiment, with the exception that extending both linear actuators 34*a*, 34*b* increases the elevation and retracting both linear actuators decreases the elevation since chassis joints 36*a*, 36*b* are lower than the multi-axle joint 30 whereas in the first embodiment chassis joints 16*a*, 16*b* are higher than the trunnion joint 10.

A gun traverse can also be effected by the tracked wheel base 32, for example by running nearside track in the opposite direction to far side track.

In both embodiments, the linear actuators (14*a*, 14*b*; 34*a*, 34*b*) are arranged symmetrically about the centreline of the gun chassis (2; 22). Further, joints between the chassis and linear actuators are in each embodiment equi-distant from the ground plane 1. Also, joints between the cradle and the linear actuators are in each embodiment equi-distant from the ground plane 1.

Whilst the arrangements of the linear actuators in the first and second embodiments are advantageous because in both cases the linear actuators are symmetrical and therefore loading on the actuators is generally equal. It will be appreciated that other arrangements are possible. For instance and referring to the first embodiment, chassis joint 16*a* may be higher than chassis joint 16*b*. Such an arrangement requires asymmetrical control of linear actuators in order to achieve selected orientation of the gun barrel axis and may lead to a reduced locus of the orientations in the vertical and azimuth planes.

In a further exemplary arrangement, linear actuators may be arranged such that a first actuator extends in a vertical plane (i.e. perpendicular to the ground plane) and a second actuator extends in a horizontal plane (i.e. parallel to the ground plane). In this case, the vertical plane linear actuator effects the elevation axis and the horizontal plane linear actuator effecting the traverse axis of the gun barrel.

The gun can be made of materials and components that would readily suggest themselves to the skilled man. Aluminium alloys would be particularly suited for forming the simpler structures. Wherever possible, the chassis 2 can be constructed from hollow rectangular sections. The posts of the chassis 2, for example, are constructed in this way. Each of these provisions minimise weight without incurring large costs.

The joints may be universal joints or may be gimballed joints so as to be able to permit the pivoting required.

The gun is suited to firing 155 mm and 105 mm munitions but the invention is equally applicable to all calibres of munition.

The invention claimed is:

1. A field gun comprising:

a chassis, a barrel defining a barrel axis and having a traverse range and an elevation range, a cradle supporting the barrel, the barrel being attached to the cradle to allow sliding engagement, a trunnion joint for enabling pivoting in at least two axes, the joint connecting the cradle to the chassis, a first linear actuator, extensible along a first linear actuator axis, pivotally attached to the chassis by a first chassis joint and pivotally attached to the cradle by a first cradle joint, and a second linear actuator, extensible along a first linear actuator axis, pivotally attached to the chassis by a second chassis joint and pivotally attached to the cradle by a second cradle joint, wherein a first combination of first linear actuator and second linear actuator actuation varies the traverse, and a second combination of first linear actuator and second linear actuator actuation varies the elevation.

2. A gun according to claim 1 wherein, relative to a polar axis extending forwards from the trunnion joint along an elevation datum line generally parallel to the ground plane, the location of the first chassis joint is defined in polar coordinates by radius $r_1$ and angle $\theta_1$, and wherein the magnitude of $\theta_1$ is greater than 90° but less than 180°.

3. A gun according to claim 2 wherein, when the barrel is at zero elevation, the location of the first cradle joint is defined in polar coordinates by radius $r_2$ and angle $\theta_2$, wherein $r_1$ is less than $r_2$, and wherein $\theta_2$ is less than 90° but greater than 0°.

4. A gun according to claim 1 wherein, when the barrel is in the midpoint of the barrel traverse range, the first linear actuator axis is substantially inclined to the barrel axis.

5. A gun according to claim 4 wherein the first linear actuator axis is inclined to the barrel axis by 20-60°.

6. A gun according to claim 5 wherein, when the barrel is in the midpoint of the barrel traverse range, the second linear actuator axis is substantially inclined to a plane defined by the barrel axis and the first linear actuator axis.

7. A gun according to claim 6 wherein the second linear actuator axis is inclined to a plane defined by the barrel axis and the first linear actuator axis by 20-60°.

8. A gun according to claim 7 wherein, relative to a polar axis extending forwards from the trunnion joint along an elevation datum line generally parallel to the ground plane, the location of the first chassis joint is defined in polar coordinates by radius $r_1$ and angle $\theta_1$, and wherein the magnitude of $\theta_1$ is greater than 90° but less than 180°.

9. A gun according to claim 8 wherein, when the barrel is at zero elevation, the location of the first cradle joint is defined in polar coordinates by radius $r_2$ and angle $\theta_2$, and wherein $r_1$ is less than $r_2$ and $\theta_2$ is less than 90° but greater than 0°.

10. A gun according to claim 9 wherein the first and second linear actuators are arranged generally symmetrically about the barrel axis when the barrel is at the traverse range midpoint.

11. A gun according to claim 1 wherein the chassis is for contacting a ground plane and comprises at least one back stabilizing leg for contacting the ground plane at a backmost point, and at least one front stabilizing leg for contacting the ground plane at a foremost point.

12. A self propelled gun comprising:

a chassis mounted on a vehicle, a barrel defining a barrel axis and having a traverse range and an elevation range, a cradle supporting the barrel, the barrel being attached to the cradle to allow sliding engagement, a trunnion joint for enabling pivoting in at least two axes, the joint connecting the cradle to the chassis, a first linear actuator, extensible along a first linear actuator axis, pivotally attached to the chassis by a first chassis joint and pivotally attached to the cradle by a first cradle joint, a second linear actuator, extensible along a first linear actuator axis, pivotally attached to the chassis by a second chassis joint and pivotally attached to the cradle by a second cradle joint, such that a first combination of first linear actuator and second linear actuator actuation varies the traverse, and a second combination of first linear actuator and second linear actuator actuation varies the elevation.

13. A gun according to claim 12 wherein the chassis comprises an automated handling system for re-loading the gun between firing.

14. A field gun comprising:

a chassis for supporting the gun on a surface of the ground;

a cradle supporting a gun barrel along a gun barrel axis, the gun barrel being attached to the cradle to allow sliding engagement;

a joint about which the gun barrel can pivot in generally vertical and azimuth planes; and two linear actuators connecting the cradle to the chassis, said linear actuators being lengthwise extendable along respective lines inclined at an angle to the barrel axis in both the vertical and horizontal planes such that pivotal movement of the gun barrel in the vertical and azimuth planes can be controlled by controlling a length of the linear actuators.

* * * * *